US005481980A

United States Patent [19]

Engel et al.

[11] Patent Number: 5,481,980

[45] Date of Patent: Jan. 9, 1996

[54] RELEASABLE SABOT FOR A SUBCALIBER PROJECTILE

[75] Inventors: Walter Engel, Schwerzenbach; Rudolf Rossmann, Bulach; Anton Ernst, Regensdorf, all of Switzerland

[73] Assignee: Oerlikon-Contraves Pyrotec AG, Zurich, Switzerland

[21] Appl. No.: 228,905

[22] Filed: Apr. 18, 1994

[30] Foreign Application Priority Data

May 27, 1993 [CH] Switzerland ..... 01594/93

[51] Int. Cl.[6] ..... F42B 14/06

[52] U.S. Cl. ..... 102/521

[58] Field of Search ..... 102/520–523, 102/532

[56] References Cited

U.S. PATENT DOCUMENTS

| | | | |
|---|---|---|---|
| 3,927,618 | 12/1975 | Engel | 102/523 |
| 4,517,899 | 5/1985 | Haberli | 102/521 |
| 4,702,172 | 10/1987 | Wallow et al. . | |
| 4,747,191 | 5/1988 | Montier et al. . | |
| 4,815,682 | 3/1989 | Feldmann et al. . | |
| 4,881,466 | 11/1989 | McGinley . | |
| 4,901,646 | 2/1990 | Feldmann et al. . | |
| 5,052,305 | 10/1991 | Chiarelli et al. | 102/522 |

FOREIGN PATENT DOCUMENTS

| | | |
|---|---|---|
| 0300373 | 1/1989 | European Pat. Off. . |
| 3050474 | 6/1986 | Germany . |

*Primary Examiner*—Harold J. Tudor
*Attorney, Agent, or Firm*—Sandler, Greenblum, & Bernstein

[57] ABSTRACT

Jettisonable sabot for a subcaliber projectile. In a jettisonable sabot for a subcaliber projectile, which is fired from a weapon barrel having helical grooves, there is a risk that individual segments of a sabot body, strike the projectile body with their edges during the separation from the projectile body, with these impacts against the projectile body impairing the impact accuracy. In order to avoid these impacts, the parting planes or slots between the individual segments of the sabot body are not arranged radially, as in the past, but rather parallel with radial planes with a specified distance (d) corresponding to at least half of the radius (R) of the projectile body, with the slits between the segments of the sabot jacket preferably being arranged parallel to radial planes with a specified distance (d).

13 Claims, 6 Drawing Sheets

RELEASABLE SABOT FOR A SUBCALIBER PROJECTILE

BACKGROUND OF THE INVENTION

1. Field of the Invention

This invention pertains to a jettisonable sabot for a subcaliber projectile for firing from a rifled weapon barrel, wherein the sabot is comprised of a sabot body and a sabot jacket, both of which are divisible into segments in order to permit separation of the sabot during exit of the projectile from the weapon muzzle.

2. Discussion of the Background of the Invention and Material Information

In a known prior art subcaliber projectile of this type, as exemplified by European patent publication EP-A-O 300 373, as well as cognate U.S. Pat. Nos. 4,815,682 and 4,901,646, the individual segments of a sabot tail portion are divided from each other via radial, flat parting planes. With this type of a subdivision of the sabot tail portion into three or more segments, difficulties are encountered at the separation of the sabot from the projectile body at the exit of the projectile from the barrel muzzle. On one hand, the individual segments, at separation, impede each other and, on the other hand, impact with the projectile body and deflect same from its trajectory so as to impair its impact accuracy. In addition, the known sabot body, divided radially through its center, is susceptible to small manufacturing inaccuracies. The segments having such inaccuracies, cannot freely release from the fin-stabilized projectile and transfer, during separation, the impulses caused by the small asymmetries to the projectile body. These unwanted impulses cause strong initial oscillations, which in turn produce greater impact deviations as well as flight time deviations.

German patent DE-30 50 474 C1 describes a sabot for a sabot fin-stabilized projectile having a pre-segmented, machined, slit, single piece body. In order to obtain increased stability of the sabot during simplified manufacturing, the slots are added to the form of the single piece sabot body so that additional workpiece material bridgings form reference fracture locations between the individual pre-segments, whereby the slots, for sealing purposes, are filled with corresponding elements made of sheet metal. With reference to an embodiment for a second sabot the additional specified workpiece material bridge in the axial center region of the sabot arrangement body is formed via opposingly arranged slots, each of which lies in a plane parallel with the diameter. In order that this additional workpiece material bridge fulfills its function as a reference fracture location, the parallel displacement of the slots can only be very minor. In addition, at the separation of the sabot from the projectile, the interfering influence upon the projectile via the uncontrolled mutual touching with one of the segments is to be reduced via an increase in the number of sabot elements.

SUMMARY OF THE INVENTION

The task or object that is accomplished via the present invention is the production of sabot which is released from the projectile body more reliably and more troublefree, preferably without subjecting the projectile body to any initial oscillations.

This task is achieved in accordance with the present invention via a jettisonable sabot for a subcaliber projectile that is capable of being fired from a weapon barrel having helical grooves, the sabot comprising a sabot body and a sabot jacket; the sabot body and sabot jacket being divisible into segments, in order to permit a separation of the sabot during the exit of the projectile from the muzzle of the weapon barrel; and wherein parting planes or slots, in the form of grooves, having reference fracture locations between the segments of the sabot body, are located parallel to radial planes at a specified distance (d) corresponding to at least half of the amount of the radius (R) of the projectile body:

In one embodiment of the jettisonable sabot of this invention, the distance (d) between the parting planes or slots and the corresponding radial planes is greater than the radius (R) of the projectile body.

In another embodiment of the jettisonable sabot of this invention, the parting planes or slots are arranged at the distance (d) in the direction (C) from the corresponding radial planes.

In a further embodiment of the jettisonable sabot of this invention, wherein certain reference fracture locations, having the edges that are generated at fracture, and the centers of gravity of the segments, are arranged in radial planes, with the radial planes being maximally spaced ten degrees apart.

Preferably, the certain reference fracture locations and the centers of gravity are arranged in the same vertical plane, and the parting planes or slots are not parallel, but rather arranged axially skewed relative to the corresponding radial planes.

In yet a further embodiment of this invention, the jettisonable sabot includes slots between the segments of the sabot jacket, wherein the slots are also parallel with the radial planes at a specified distance (d1). Preferably, the slots between the segments of the sabot jacket, opposite to the parting planes or slots, are displaced between the segments of the sabot body.

In an additional embodiment of the jettisonable sabot of this invention, the reference fracture locations, that join together the individual segments of the sabot body, extend over the entire length of the sabot body.

In yet further embodiments of the jettisonable sabot of this invention, the reference fracture locations are located at the front and the rear ends of the sabot body, or at the rear end of the sabot body, or at the front end of the sabot body. Preferably, the reference fracture locations, that extend over the entire length of the sabot body, taper toward the front or rear, in the direction of firing.

The special arrangement of the parting planes or surfaces between the individual segments of the sabot body achieves that, during separation of these segments from the projectile body, impacts of the segments with the projectile body are avoided.

This has the advantage that the impact accuracy of the subcaliber projectile or the sabot projectile is improved.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
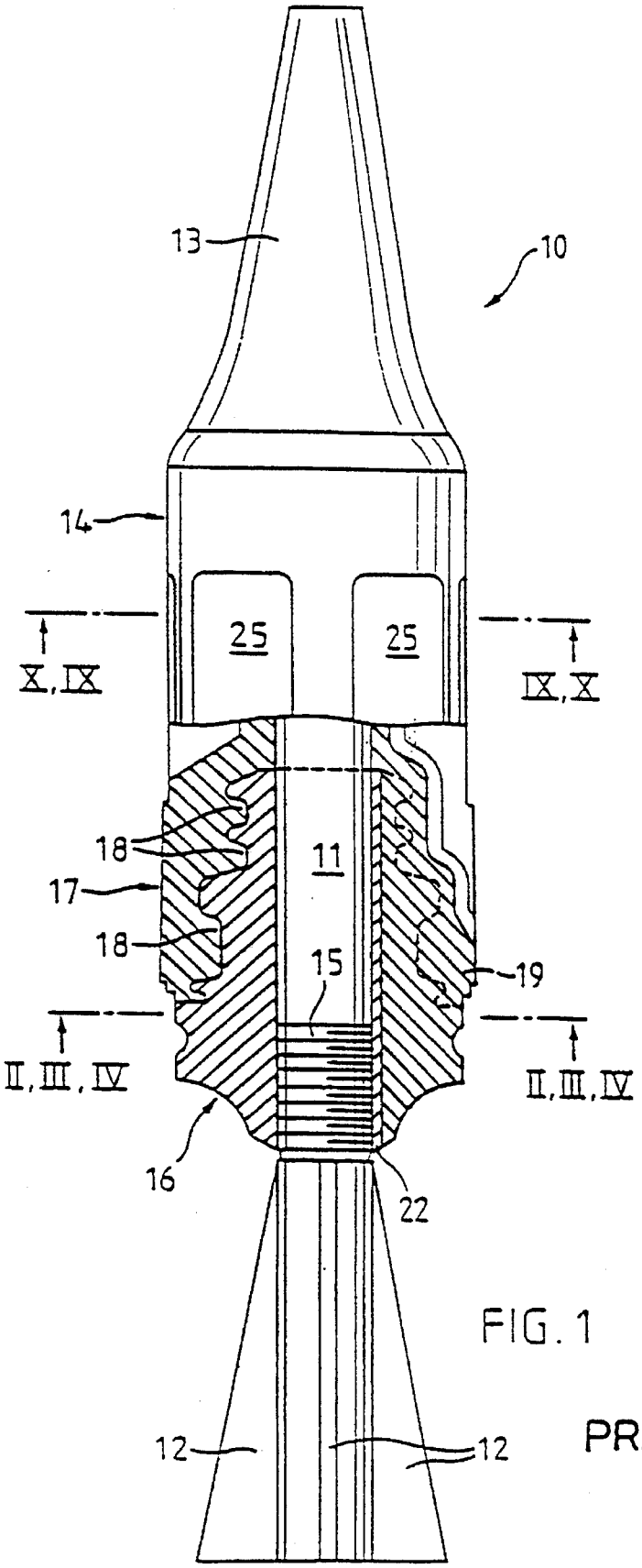
FIG. 1 PRIOR ART
FIG. 1 is a view of a sabot projectile, partially in section, taken along line I—I of FIG. 2.

FIG. 1 shows a sabot projectile 10 including a fin-stabilized projectile body 11 having stabilizing wings 12 at its rear end. The tip of the fin-stabilized projectile body 11 is located within a cover 13, which is attached on a sabot 14. The center portion of fin-stabilized projectile body 11 includes a thread 15, upon which sabot 14 is threaded. The sabot 14 is comprised of a sabot jacket 17 and a sabot body 16. Sabot jacket 17 is preferably made of plastic, with sabot body 16 preferably being made of aluminum. In addition, cover 13 is also preferably made of plastic. Both sabot body 16 and sabot jacket 17 are, in typical fashion, connected together via a plurality of circumferential grooves 18, which are particularly clearly shown in FIGS. 7 and 8.

Figure 2:
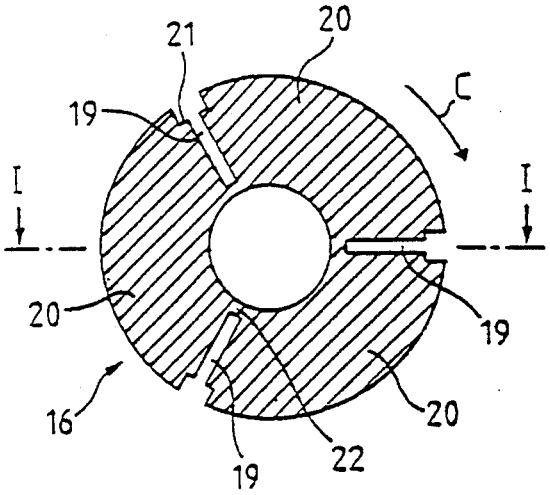
FIG. 2 PRIOR ART
FIG. 2 is a section, taken along line II—II of FIG. 1, only through the sabot body having a known radial arrangement of the segment separation.
Figure 5:
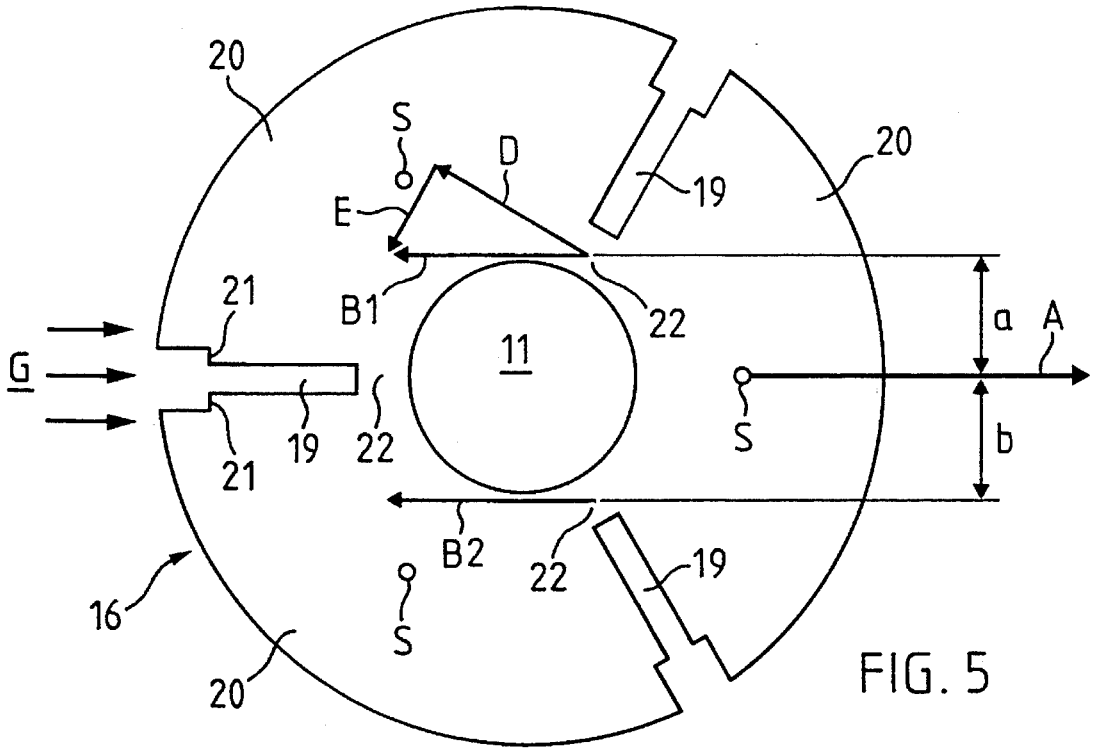
FIG. 5 is a slightly enlarged view of that of FIG. 2 with the projectile body, however rotated 60° and without section lines, showing the forces at work during the separation of the sabot.
Figure 6:
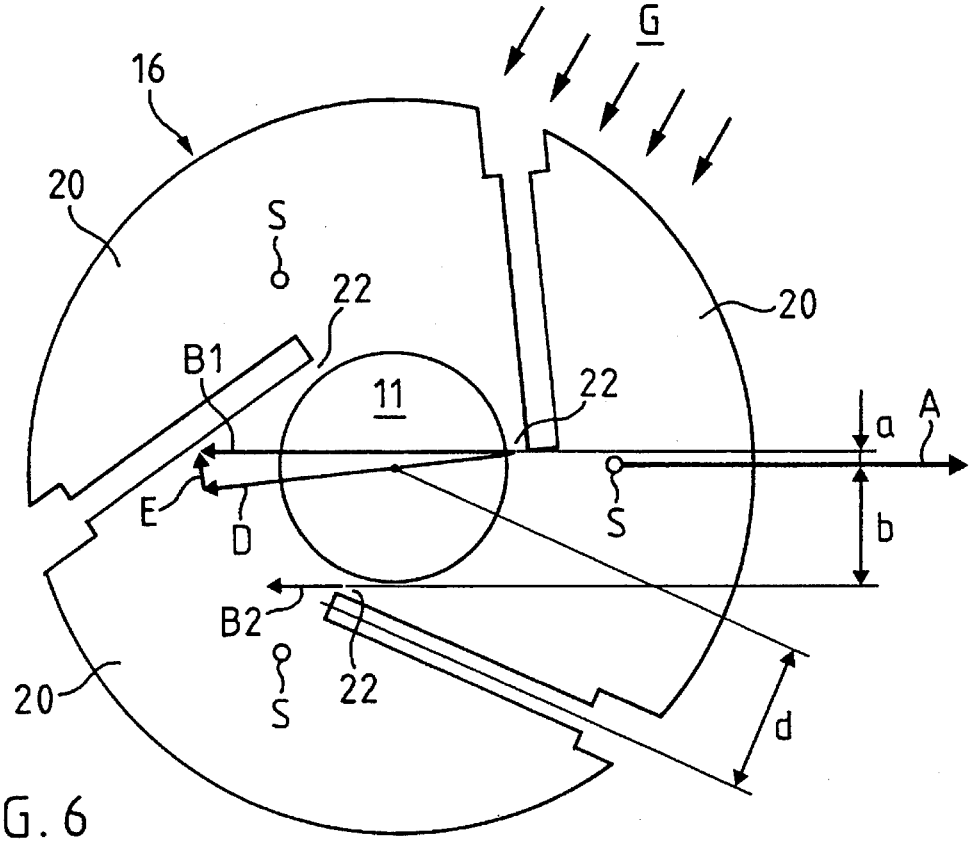
FIG. 6 is a slightly enlarged view of that of FIG. 4 with the projectile body, however slightly rotated and without section lines, showing the forces at work during the separation of the sabot.
Figure 7:
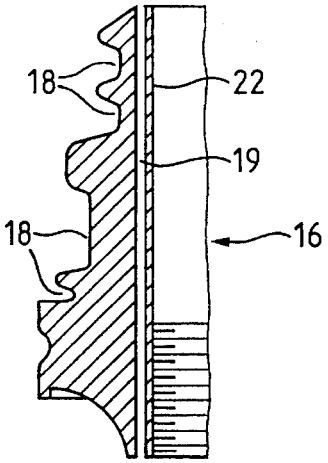
FIG. 7 is a longitudinal section, taken along line VII—VII of FIG. 4, showing a reference fracture location extending over the entire length of the sabot body.
Figure 8:
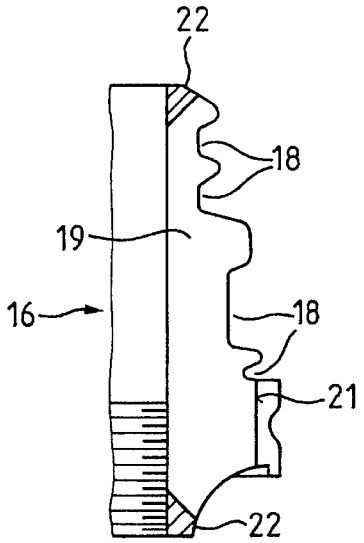
FIG. 8 is a longitudinal section, taken along line VIII—VIII of FIG. 3, showing a reference fracture location at the rear and front ends of the sabot.

The assembly and construction of sabot body 16 will now be described with reference to FIGS. 2 to 4 and FIGS. 7 and 8, wherein, in the interest of simplification and clarity, sabot body 16 is shown as a single piece, which however in terms of its mode of operation is integrated with sabot 14. In order that sabot 14 can separate during the firing of the projectile at the exit from the muzzle of the weapon barrel, sabot body 16 is subdivided into segments 20 via parting planes 29 or slots, such as grooves 19, having associated reference fracture locations or predetermined breaking points 22, as best shown in FIGS. 7 and 8. As shown in FIG. 2, the segment separation is usually accomplished with known parting planes 29. As per FIG. 2, preferably three slots or grooves 19, equally spaced around the circumference, are utilized, whereby three segments 20 are thus formed. The slots or grooves 19 are enlarged at their outer ends via shoulders 21 that are also shown in FIGS. 5 and 6. The inner ends of the slots or grooves 19 are provided with a reference fracture location 22, which will be described in more detail hereinafter.

It has now been determined that this radial arrangement of parting planes 29 or slots 19 causes problems during the separation of sabot 14 from projectile body 11. Due to the influence of the projectile spin, in the direction of arrow C (FIGS. 2–4), on one hand, centrifugal forces act upon the individual segments 20 of sabot body 16, while on the other hand, rotating forces also act upon the individual segments 20, which endeavor to turn or rotate each individual segment about its own center of gravity S.

As per FIG. 5, acting upon an individual segment 20 of sabot body 16, is a centrifugal force A which endeavors to separated this segment 20 from its two neighboring segments 20. Acting upon each of the two reference fracture locations 22, which connect segment 20 with both of its neighboring segments 26, are forces B1 and B2, which can be of differing magnitudes, but which here are of the same value, depending upon the distance of the center of gravity S of the reference fracture locations 22.

In case the distance a of the one reference fracture location from the center of gravity is somewhat smaller than the distance b of the other reference fracture location from the center of gravity S, then force B1 is somewhat greater than force B2. Both forces B1 and B2 can be broken down into a tension force D and a shear force E.

Figure 2A:
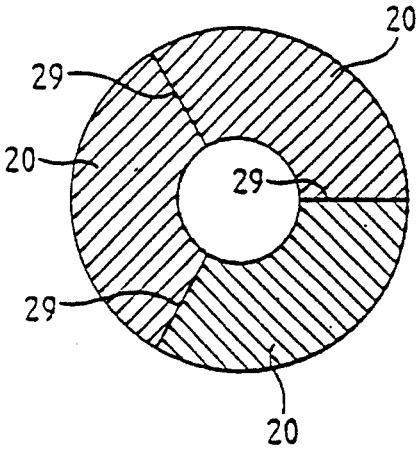
FIG. 2a PRIOR ART
FIG. 2*a* is similar to FIG. 2, however showing a known segment separation.
Figure 3:
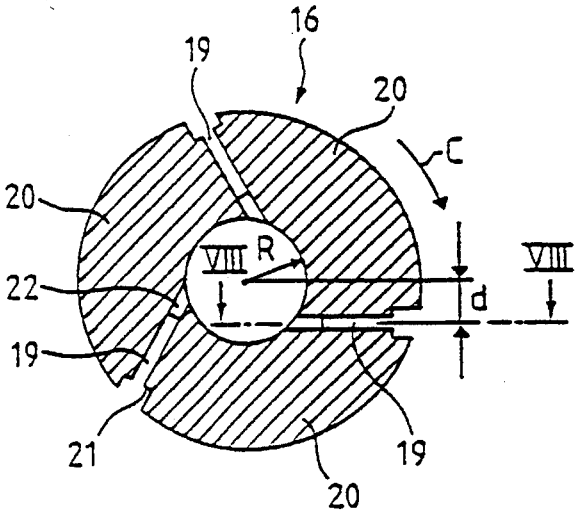
FIG. 3 is a section, taken along line III—III of FIG. 1, only through a sabot body, in accordance with a first embodiment on the invention.
Figure 4:
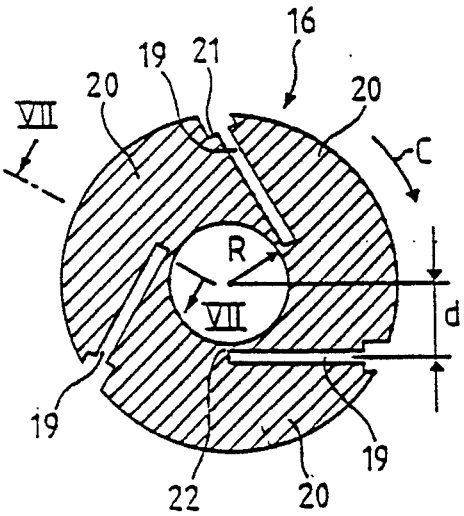
FIG. 4 is a section, taken along line IV—IV of FIG. 1, only through a sabot body in accordance with a second embodiment of the invention.

As shown in FIGS. 3 and 4, the slots of grooves 19 are not arranged in a radial plane, but rather at a distance d parallel to such a radial plane. This arrangement of the slots or grooves 19, as well as also the arrangement of the parting planes 29, as per FIG. 2*a*, at a distance d from a radial plane at a region yet to be defined is deemed essential to the invention, since as a result thereof the separation of segments 20 from projectile body 11 is markedly improved. This will be discussed hereinafter, particularly with reference to the preferred slots 19.

As shown in FIG. 6, acting, on an individual segment 20 of the sabot body, is a centrifugal force A, which endeavors to separate or sever a segment 20 from its two neighboring segments 20. Acting upon the two reference fracture locations 22, which connect segment 20 with its two neighboring segments 20, are forces B1 and B2, which are very different in this instance. Since the distance a of the one reference fracture location 22 from the center of gravity S is much smaller than the distance b of the other reference fracture location, force B1 is substantially larger than force B2. Both forces B1 and B2 can be broken down into a tension force D and a shear force E, with force B1 being greatest when a=O, that is when the center of gravity S and the reference fracture location reside in the same radial plane, which is desirable, of course.

As shown in FIG. 7 the reference fracture location 22 extends, when viewed in the axial direction, over the entire length of sabot body 16. As shown in FIG. 8, one reference fracture location 22 is provided at the front and rear ends of the sabot body. If desired, one of these reference fracture locations can be omitted or dispensed with at either the rear end or the front end of the sabot body.

The arrangement of the slots or grooves 19 between segments 20 of sabot body 16, parallel to one radial plane, and at the requisite distance, has the particular advantage that the sealing of the slots or grooves 19 is markedly improved and which can be seen in a comparison of FIGS. 5 and 6, with the gas pressure being represented by radial arrows G. As shown in FIG. 5, the plastic mass in groove 19 of sabot jacket 17, which is only shown in FIG. 1, is pressed against shoulders 21. Thereby, the sealing is primarily assured via these shoulders. In contrast thereto, as shown in FIG. 6, the individual segments 20 are pressed more strongly against each other, whereby better sealing is assured, particularly since the active gas pressure area is greater.

Figure 9:
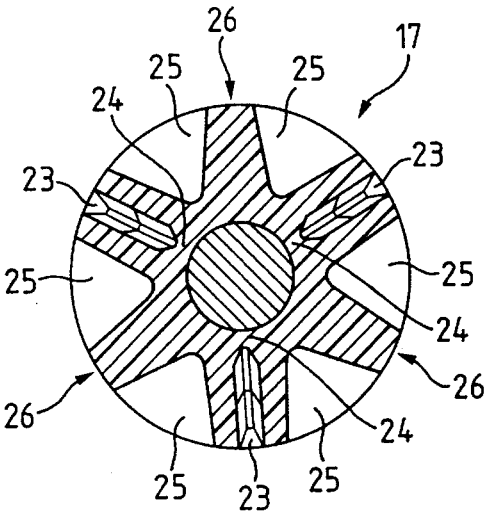
FIG. 9 is a section, taken along line IX—IX of FIG. 1 through the sabot jacket.

As shown in FIG. 9, the sabot jacket 17 is also subdivided, via three radial slots or grooves 23, into three jacket segments 26 which are connected with each other via three jacket reference fracture locations 24. Each segment 26 includes two recesses or cavities 25 in order to avoid excess mass.

Figure 10:
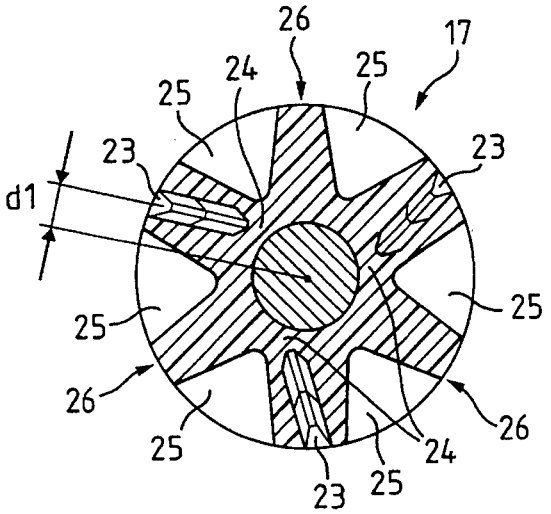
FIG. 10 is a section, taken along line X—X of FIG. 1, in accordance with an embodiment of this invention pertaining to the sabot jacket.

As shown in FIG. 10, these slots or grooves 23 are not arranged in a radial plane, but rather at a distance d1 (which can be same as or differ from the distance d shown in FIGS. 3 and 4) parallel to such a radial plane. The slots or grooves 23 of sabot jacket 17 can coincide with the slots or grooves 19 of sabot body 16, or can be offset relative to each other. In a sabot body 16, having slot 19 that are, at a distance, arranged parallel to a radial plane, a sabot jacket can be utilized which has either radially arranged slots 23 or slots 23 that, at a distance, are arranged parallel to a radial plane.

The reference fracture location 22 shown in FIG. 7 is uniform over its entire length, that is, of the same dimension, but can, however be of a lesser or weaker extent forwardly or rearwardly, when viewed in the direction of firing, in order to avoid an inclination or skewing of segments 20 after the separation from projectile body 11.

As shown in FIG. 3, the given or specified distance or spacing d between the slot 19 and the corresponding radial plane is smaller than the radius R of the bore required for projectile body 11. As shown in FIG. 4 the specified distance d between slot 19 and the corresponding radial plane is somewhat greater than the radius R of the bore, for example, at the dimension of a reference fracture location. Tests have confirmed that this greater distance d is more advantageous. Thus, it has been determined, according to the invention, that the distance d must correspond to at least to half of the amount of the radius R of the projectile body.

In addition, the parting planes 29 or slots or grooves 19 can preferably, as shown in FIGS. 3 and 4, instead of being arranged in parallel, be skewed relative to the corresponding radial planes.

Figure 11:
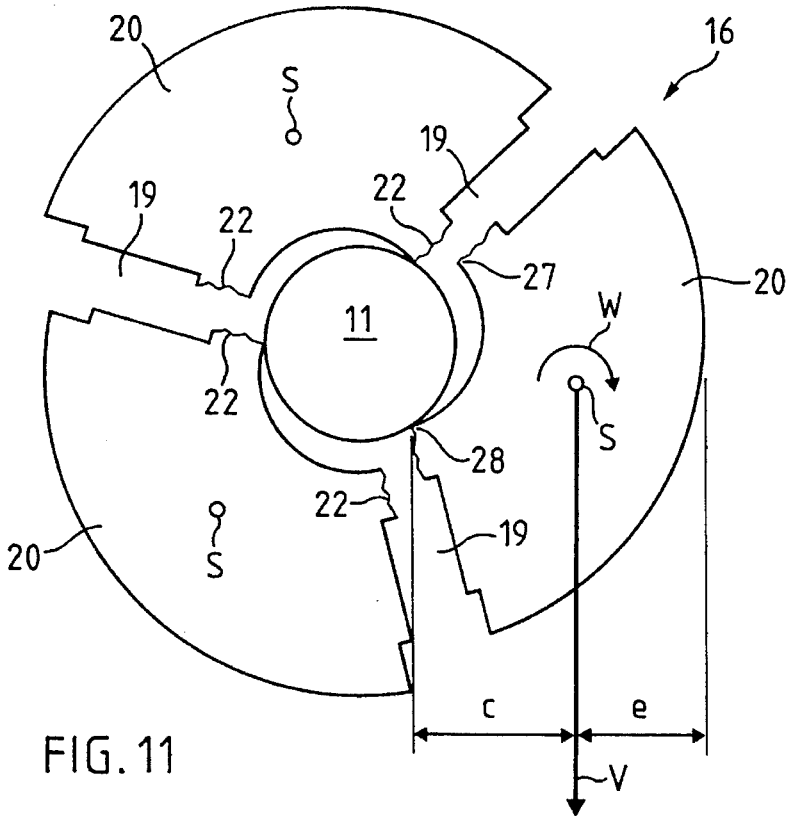
FIG. 11 is the same view as in FIG. 5, shortly after the separation.

As shown in FIG. 11, the individual segments 20 of sabot body 16, after their separation from projectile body 11, fly off in the direction of arrow V, that is tangentially to projectile body 11. At the same time, each segment 20 begins to turn about its center of gravity S, as is indicated by arrow W. Due to the movement in the direction of arrow V, segment 20 initially strikes, with an edge 27 of the one fracture reference location 22, the projectile body 11 and, via the turning or rotation of segment 20 about the center of gravity S, in the direction of arrow W, segment 20 thereafter strikes, via an edge 28 of the other reference fracture location, against the projectile body 11.

As result thereof projectile body 11 is diverted from its desired path or trajectory.

According to the invention, this result is to be avoided. Just how these two impacts of the segments 20 of the sabot body, with the projectile body 11, are avoided, will now be described with reference to FIGS. 12 and 13.

Figure 12:
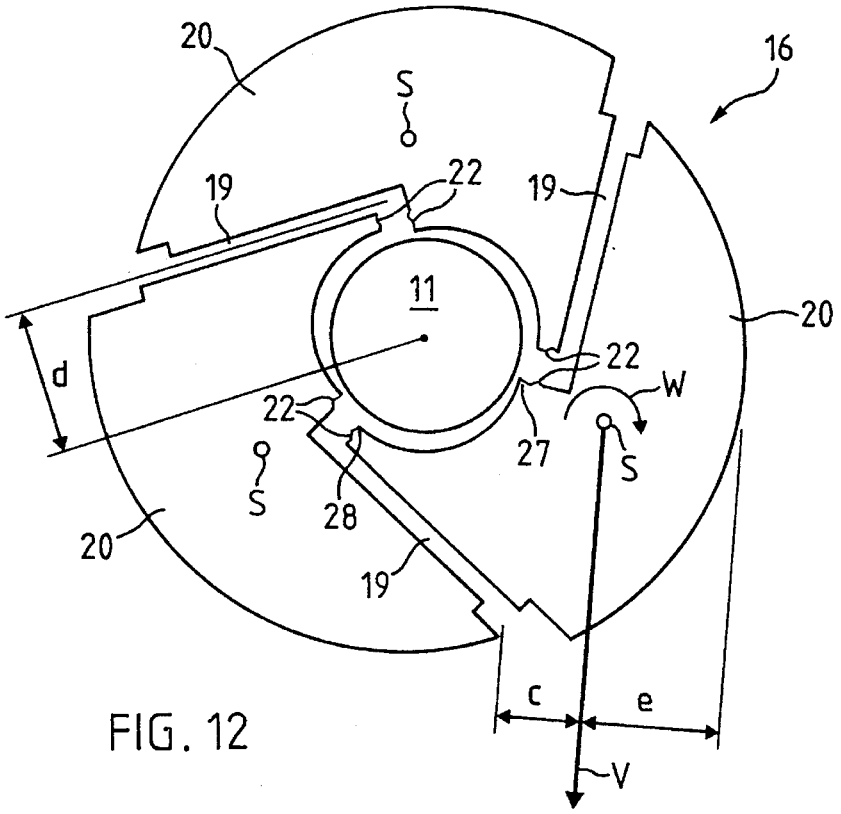
FIG. 12 is the same view as in FIG. 6, shortly after the separation.
Figure 13:
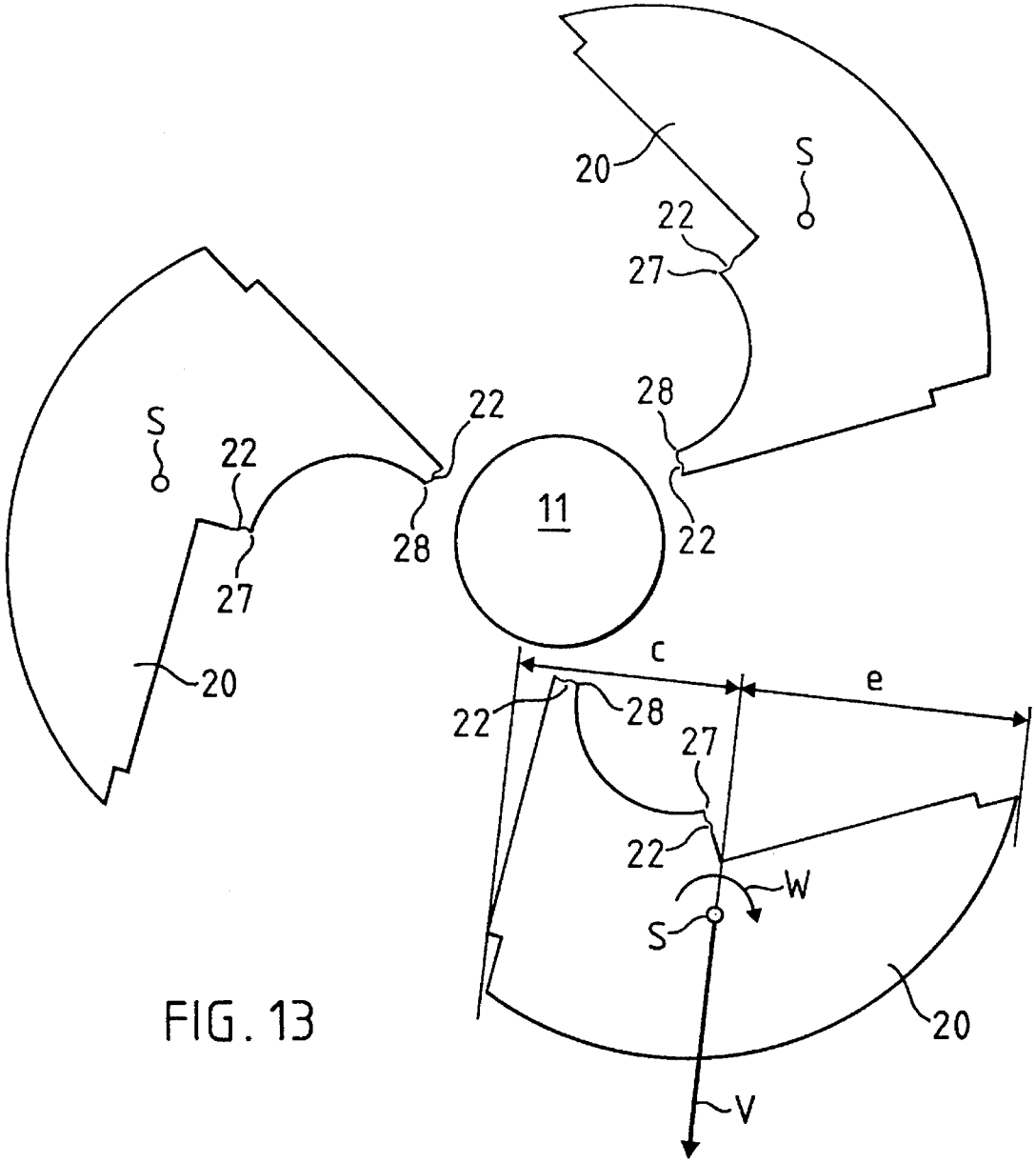
FIG. 13 is the same view as in FIG. 12, but somewhat later, after the separation.

As per FIGS. 12 and 13, the individual segments 20 of sabot body 16, after their separation from projectile body 11, fly off in the direction of arrow V, which is tangentially relative to projectile body 11. At the same time, each segment 20 begins to turn or rotate about its center of gravity S in the manner indicated by arrow W. As a result of the differing arrangement of slots 19, now neither edge 27 of the one reference fracture location, nor the edge 28 of the other reference fracture location, can impact with projectile body 11.

As has already been noted, slots 19 are arranged at a distance d, parallel to the corresponding radial plane, and this distance d is so chosen that the noted impacts are avoided.

The air resistance acting upon a segment 20 is shown in FIGS. 11, 12 and 13 via the distances c and e. As shown in FIG. 11, the distance c is greater than the distance e, thus the air resistance acts in the sense of arrow W and thus augments the turning of the segment about its center of gravity S. As per FIGS. 12 and 13, the distance c is less than the distance e, thus the air resistance opposes the turning, in the sense of arrow W, and reduces or prevents the danger that edge 28 of segment 20 impacts with sabot body 11.

In summary, it can be stated that as soon as sabot body 16 leaves the barrel muzzle and breaks up into the three segments 20, instead of the centrifugal force A, a translational velocity in the direction of arrow V and an angular velocity in the direction of arrow W act in the manner of FIGS. 5 and 6. As shown in FIG. 5, as a result of the translational velocity in the direction of arrow V, edge 27 of segment 20 impacts with projectile body 11 and thereafter causes the turning of segment 20 in the direction of arrow W, so that the edge 28 of segment 20 impacts with projectile body 11.

These two impacts of segment 20 with projectile body 11 are avoided by means of the arrangement, according to the invention, of the known parting planes 29 or the preferred slots 19 with a distance d of at least R/2 relative to a radial plane, or preferably, d>R, in the manner shown in FIGS. 12 and 13. Therewith, the distance d relative to the radial plane, must be determined in the direction of spin indicated by arrow C shown in FIGS. 4 and 5. In addition, it is advantageous to arrange the one reference fracture location 22, which produces the edge 27 at breakup, and the center of gravity S of segment 20, in the same radial plane or in radial planes which are maximally spaced 10 angular degrees apart.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A jettisonable sabot for a subcaliber projectile that is capable of being fired from a weapon barrel having helical grooves, said sabot comprising;

a sabot body and a coaxial sabot jacket, with said sabot body and said sabot jacket having a central aperture for receiving the subcaliber projectile;

said sabot body and sabot jacket being divisible into segments, in order to permit a separation of the sabot during the exit of the subcaliber projectile from the muzzle of the weapon barrel; and wherein one of parting planes and slots, in the form of grooves, having reference fracture locations between the segments of the sabot body, are located parallel to radial planes at a specified distance (d), wherein the distance (d) between one of the parting planes and slots and the corresponding radial planes is greater than a radius (R) of a projectile body.

2. The jettisonable sabot of claim 1, wherein one of the parting planes and slots are arranged at the distance (d) in the direction of spin (C) from the corresponding radial planes.

3. The jettisonable sabot of claim 2, wherein certain reference fracture locations, having the edges that are generated at fracture, and wherein centers of gravity of the segments, are arranged in radial planes, with said radial planes being maximally spaced ten degrees apart.

4. The jettisonable sabot of claim 2, wherein said certain reference fracture locations and centers of gravity of the segments are arranged in the same vertical plane.

5. The jettisonable sabot of claim 2, having slots between the segments of the sabot jacket, wherein said slots are also parallel with the radial planes at a specified distance (d1).

6. The jettisonable sabot of claim 2, wherein the slots between the segments of the sabot jacket are one of, coincident with the parting planes and slots of the sabot body, and offset relative to each other.

7. A jettisonable sabot for a subcaliber projectile that is capable of being fired from a weapon barrel having helical grooves, said sabot comprising;

a sabot body and a coaxial sabot jacket, with said sabot body and sabot jacket having a central aperture for receiving the subcaliber projectile;

said sabot body and sabot jacket being divisible into multiple segments, in order to permit a separation of the sabot during the exit of the subcaliber projectile from the muzzle of the weapon barrel; and wherein grooves, with the grooves having reference fracture locations between the segments of the sabot body, are located parallel to radial planes at a specified distance (d) greater than a radius (R) of a projectile body.

8. The jettisonable sabot of claim 7, wherein the grooves are arranged at the distance (d) in the direction of spin (C) from the corresponding radial planes.

9. The jettisonable sabot of claim 8, wherein certain reference fracture locations, having the edges that are generated at fracture, and wherein centers of gravity of the segments, are arranged in radial planes, with said radial planes being spaced a maximum of ten degrees apart.

10. The jettisonable sabot of claim 8, wherein said certain reference fracture locations and centers of gravity of the segments are arranged in the same vertical plane.

11. The jettisonable sabot of claim 8, having slots between the segments of the sabot jacket, wherein said slots are also parallel with the radial planes at a specified distance (d1).

12. The jettisonable sabot of claim 11, wherein the slots between the segments of the sabot jacket are one of, coincident with the parting planes and slots of the sabot body, and offset relative to each other.

13. The jettisonable sabot of claim 7, wherein the reference fracture locations, that join together the individual segments of the sabot body, extend over the entire length of the sabot body.

* * * * *